US006415938B1

(12) United States Patent
Karpisek

(10) Patent No.: US 6,415,938 B1
(45) **Date of Patent: *Jul. 9, 2002**

(54) CONTAINERS

(76) Inventor: Ladislav Stephan Karpisek, 92 Woodfield Boulevarde, Caringbah, New South Wales 2229 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/743,523

(22) PCT Filed: Jul. 7, 1999

(86) PCT No.: PCT/AU99/00551

§ 371 (c)(1),
(2), (4) Date: Jan. 11, 2001

(87) PCT Pub. No.: WO00/02787

PCT Pub. Date: Jan. 20, 2000

(30) Foreign Application Priority Data

Jul. 7, 1998 (AU) ..... PP4518

(51) Int. Cl.[7] ..... B65D 6/22

(52) U.S. Cl. ..... 220/1.5; 220/6; 220/7; 220/4.32; 220/4.34

(58) Field of Search ..... 220/1.5, 6, 7, 4.32, 220/4.34

(56) References Cited

U.S. PATENT DOCUMENTS

| | | | | | |
|---|---|---|---|---|---|
| 3,941,271 | A | * | 3/1976 | Zarges et al. | 220/6 |
| 3,999,676 | A | * | 12/1976 | Trebilcock et al. | 220/6 |
| 4,005,795 | A | * | 2/1977 | Mikkelsen et al. | 220/7 |
| 5,114,037 | A | * | 5/1992 | Hillis et al. | 220/6 |
| 5,938,059 | A | * | 8/1999 | Luburic | 220/7 |

* cited by examiner

*Primary Examiner*—Joseph M. Moy
(74) *Attorney, Agent, or Firm*—Edwin D. Schindler

(57) ABSTRACT

A container (1) comprising a base (2) and four side panels (6, 7, 8, 9), a pair of opposed side panels (6, 8) are coupled to upstanding corner posts (10) of the base (2) and the other pair of panels (7, 9) are coupled to rails (5) upstanding from the base (2), the couplings (14, 17 and 44, 19) normally allow the panels to be moved between upstanding condition where the panels are interlocked with each other and are held by retainers (12) to the base (2) and the rails (5), and storage condition where the panels lie one over the other over the base. The couplings are through panel mounted track followers (14, 44) engaged in "L" shaped tracks (17, 19) in the corner posts (10) and the rails (5) respectively. First limbs (**17*a*, 19*a*) of the "L" shaped tracks (17, 19) are open ended allowing sequential demounting of the panels (6, 8 and 7, 9) from the base (2) by passage of the track followers (14, 44) through the open ends of the tracks (17, 19). Demounting of the panels (7, 9) coupled to the rails (5) is normally prevented until the panels (6, 8) coupled to the posts (10) have been demounted from the base (2**).

16 Claims, 9 Drawing Sheets

FIG. 3.
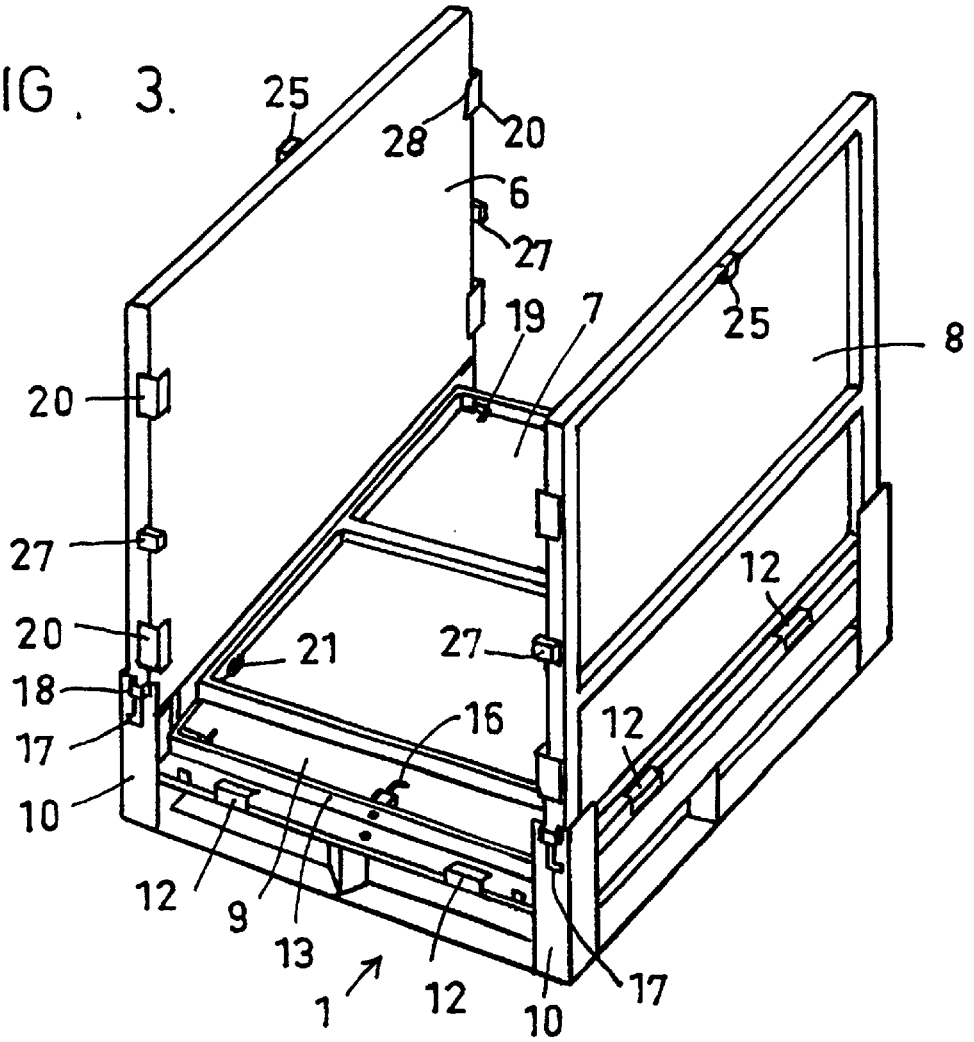
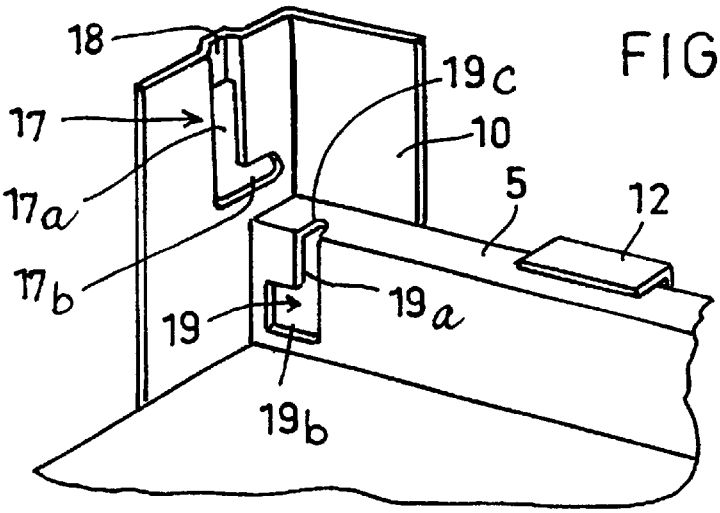
FIG. 4.

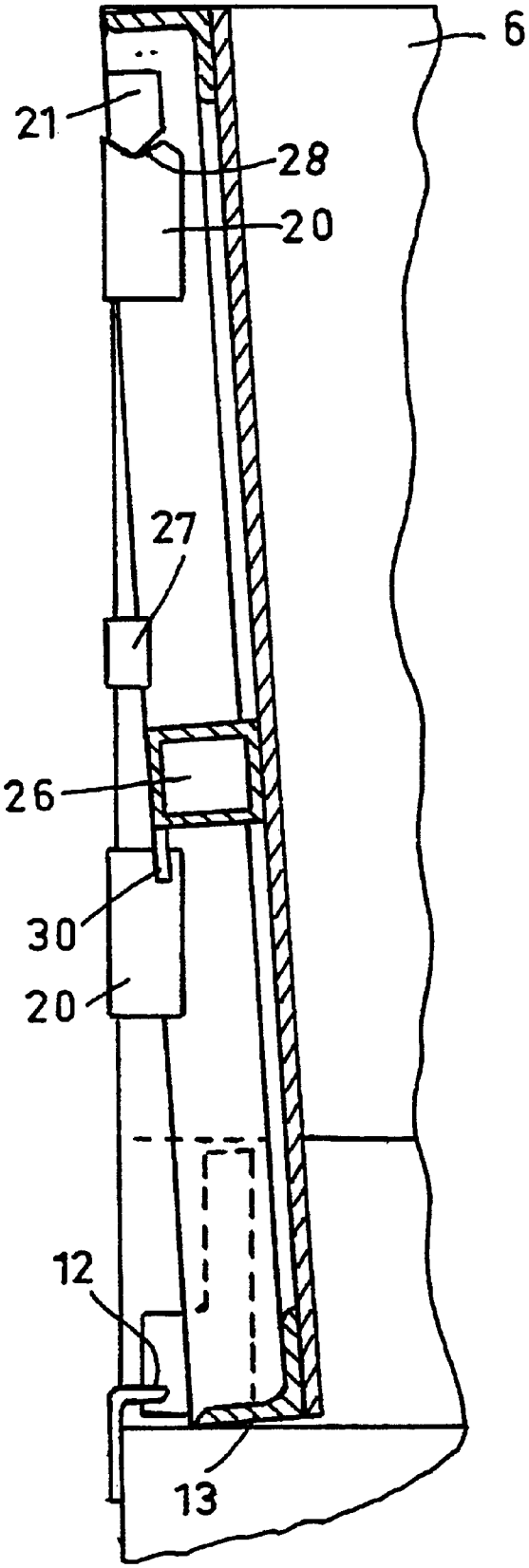
FIG. 10.
FIG. 11.
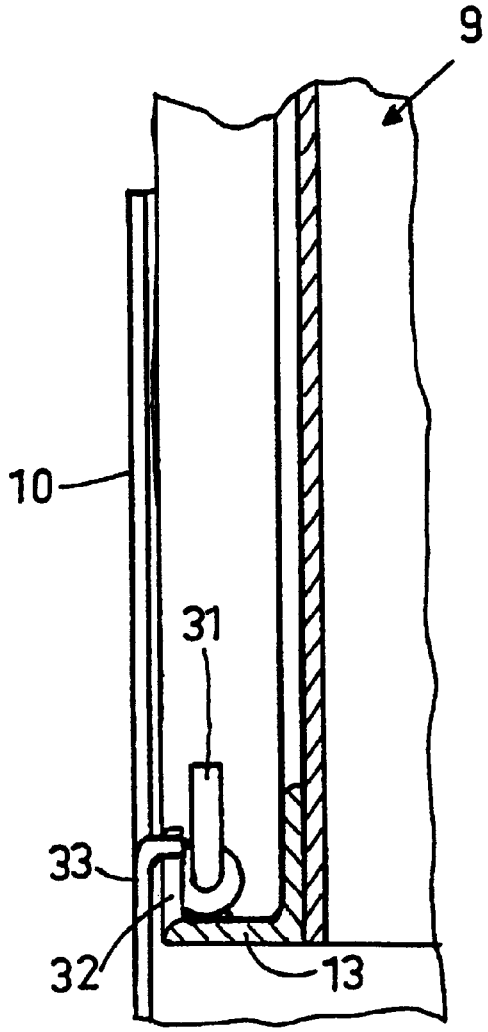

CONTAINERS

FIELD OF INVENTION

This invention relates to containers of the type including a base and four side panels coupled to the base so as to be able to fold down side panel over side panel and all over the base, and to which a lid can be fitted.

BACKGROUND TO THE INVENTION

Forms of containers of the above type known to the applicant are usually found by users to have shortcomings. One shortcoming is that the panels are permanently connected to the base or are connected to the base in a manner requiring considerable work to be done to demount the panels. Ready demounting of the panels is desirable to facilitate cleaning of the container between uses and in some applications the ready demounting of one panel is required to facilitate the precise positioning of a liner bag in the container.

Another shortcoming is that the erection of the panels from the folded down storage condition to the secured upstanding operational condition on the base involves considerable manual effort when, as is the case with the known containers, the operator erecting the container has to lift the considerable weight of a panel in order to position it in the operational condition. In some containers the side panels are of different sizes and whilst the smaller panels can be manhandled with reasonable effort there is a need to minimise the effort required to erect the larger panels.

OBJECTS OF THE INVENTION

An object of the invention is to provide panel to base connections which allow the folding down of the panels and ready demounting of the panels from the base.

Another object is to provide a construction which minimises the effort needed by an operator to erect a panel and substantially limits the movement given to the panel by the operator to arcuate movement.

Other objects of the invention are to provide means whereby a panel of a container can be demounted from the base whilst the other three panels remain in the operational condition and to provide a lid latch which is simple and effective.

BROAD STATEMENTS OF THE INVENTION

This invention provides a container comprising a four sided base, four side panels, coupling means coupling said panels respectively to the base at the four sides of the base, said coupling means allowing the panels to be moved between operative condition where they are upstanding on the base and storage condition where the panels lie one over the other over the base, releasable securing means to secure together adjacent edges of the panels when they are upstanding on the base, the panels are arranged in pairs with a first pair of panels of a first height respectively mounted at two opposite sides of the base and coupled by the coupling means to corner posts on the base, the panels of said first pair when upstanding rest on raised rails on the base at opposite sides of said base extending between corner posts of the base and are engaged with retainers on said rails, the other pair of panels are of greater height that said first pair of panels and are respectively coupled by said coupling means to corresponding ends of said rails and when upstanding rest on the base and are engaged with retainers on the base, said coupling means comprises track followers on the panels and tracks in said posts and said rails, said track followers can pivot in said tracks to allow arcuate movement of said panels, each of said tracks has a first portion which is open at one end and communicates at a second end with a track further portion, track followers when engaged in said track first portions can move in directions towards and away from the base to allow the panels after arcuate movement to be stacked one on the other on the base, said track followers when engaged in said further track portions can move in directions substantially parallel to the plane of the base to allow engagement and disengagement of the panels when upstanding with said retainers, all of the panels can be demounted from the base by disengagement of their track followers from the first portions of said tracks through the open ends thereof, the panels of said first panel pair occlude the open ends of the first portions of the rail tracks thereby preventing the removal of the panels of said other panel pair prior to the demounting from the base of the panels of said first panel pair.

This invention further provides a container comprising a four sided base, four side panels, coupling means coupling said panels respectively to the base at the four sides of the base, said coupling means allowing the panels to be moved between operative condition where they are upstanding on the base and storage condition where the panels lie one over the other over the base, releasable securing means to secure together adjacent edges of the panels when they are upstanding on the base, the panels are arranged in pairs with a first pair of panels of a first height respectively mounted at two opposite sides of the base and coupled by the coupling means to corner posts on the base, the panels of said first pair when upstanding rest on raised rails on the base at opposite sides of said base extending between corner posts of the base and are engaged with retainers on said rails, the other pair of panels are of greater height that said first pair of panels and are respectively coupled by said coupling means to corresponding ends of said rails and when upstanding rest on the base and are engaged with retainers on the base, said coupling means comprises track followers on the panels and tracks in said posts and said rails, said track followers can pivot in said tracks to allow arcuate movement of said panels, each of said tracks has a first portion which is open at one end and communicates at a second end with a track further portion, track followers when engaged in said track first portions can move in directions towards and away from the base to allow the panels after arcuate movement to be stacked one on the other on the base, said track followers when engaged in said further track portions can move in directions substantially parallel to the plane of the base to allow engagement and disengagement of the panels when upstanding with said retainers, said retainers comprise hookingly engaged complementarily shaped hooking elements on said panels and on said rails and said base, said securing means including notched members on the panels of said first panel pair and lugs on the panels of said other panel pair shaped to engage in notches of said notched members and when so engaged provide a pivot point for pivotal movement of panels to hookingly engage and disengage said retainers.

This invention also provides a container comprising a four sided base, four side panels, coupling means coupling said panels respectively to the base at the four sides of the base, said coupling means allowing the panels to be moved between operative condition where they are upstanding on the base and storage condition where the panels lie one over the other over the base, releasable securing means to secure together adjacent edges of the panels when they are upstanding on the base, the panels are arranged in pairs with a first pair of panels of a first height respectively mounted at two opposite sides of the base and coupled by the coupling means to corner posts on the base, the panels of said first pair when upstanding rest on raised rails on the base at opposite sides of said base extending between corner posts of the base and are engaged with retainers on said rails, the other pair of panels are of greater height that said first pair of panels and are respectively coupled by said coupling means to corresponding ends of said rails and when upstanding rest on the base and are engaged with retainers on the base, said coupling means comprises track followers on the panels and tracks in said posts and said rails, said track followers can pivot in said tracks to allow arcuate movement of said panels, each of said tracks has a first portion which is open at one end and communicates at a second end with a track further portion, track followers when engaged in said track first portions can move in directions towards and away from the base to allow the panels after arcuate movement to be stacked one on the other on the base, said track followers when engaged in said further track portions can move in directions substantially parallel to the plane of the base to allow engagement and disengagement of the panels when upstanding with said retainers, all of the panels can be demounted from the base by disengagement of their track followers from the first portions of said tracks through the open ends thereof, the panels of said first panel pair occlude the open ends of the first portions of the rail tracks thereby preventing the removal of the track followers of said other panel pair from their associated tracks prior to the demounting from the base of the panels of said first panel pair, and wherein at least one of the panels of said other panel pair is a slip panel having at least one of its track followers retractable to allow subsequent manipulation of the slip panel to disengage it from said base whilst the panels of said first panel pair remain coupled to the base.

BRIEF DESCRIPTION OF THE DRAWINGS

FIG. 3 is a view similar to FIG. 2 with come of the side panels of the container folded down to a storage condition.

FIG. 4 is a pictorial scrap view of a corner of the base of the container showing detail of a base corner post, FIG. 10 shows the first stage in the process of moving a panel from the upstanding operative condition to the folded down storage condition, FIG. 11 is a fragmentary sectional edge view showing the positioning of a first form of retractable pin for coupling the panel to the base, with the panel in the erected condition.

DETAILED DESCRIPTION OF THE DRAWINGS

Figure 1:
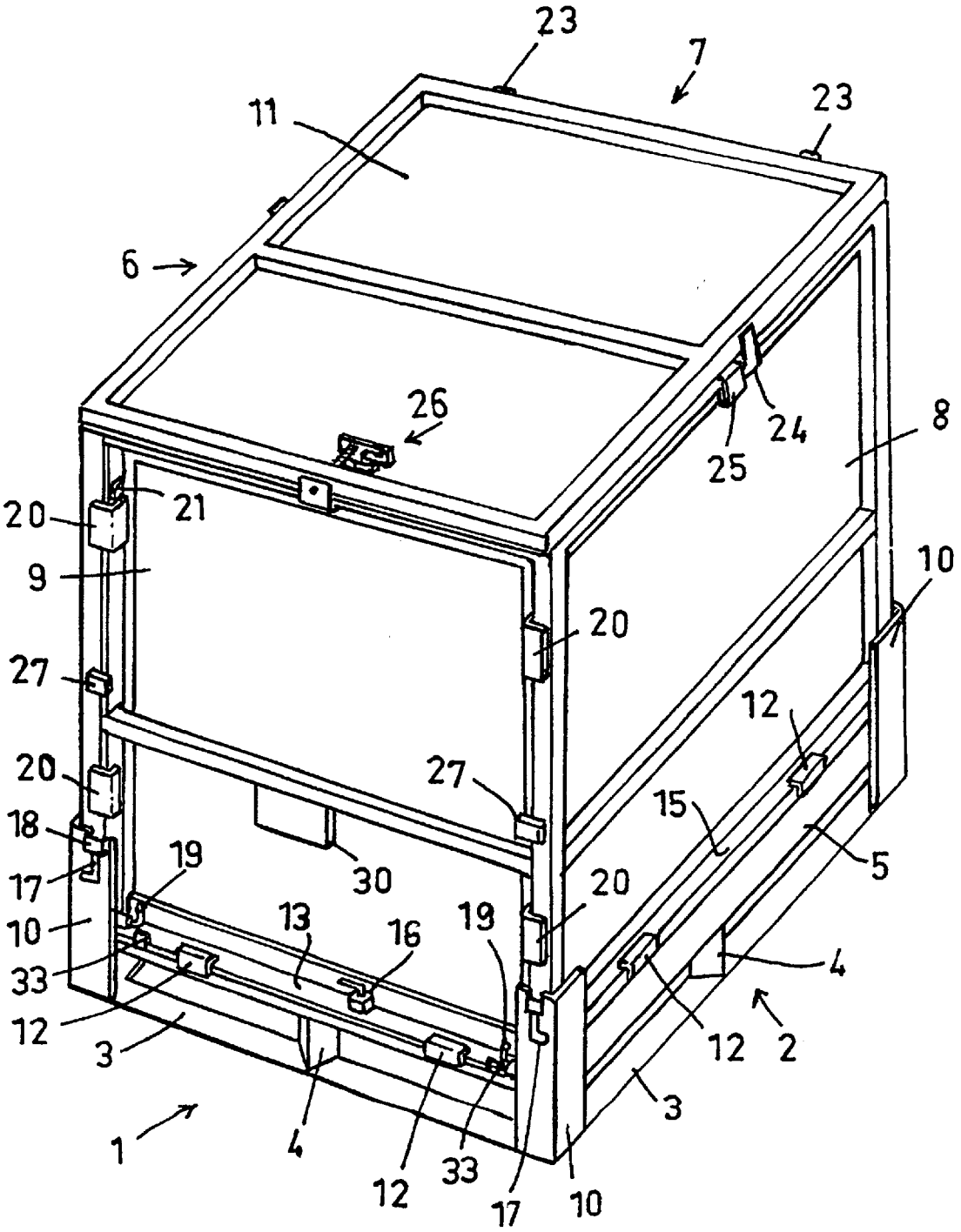
FIG. 1 is a pictorial view of a container according to the present invention.

In FIG. 1 there is shown generally an erect container of the present invention indicated 1. The container comprises a four sided base 2 of the form of a pallet which allows four way entry for a pallet moving device, such as a fork lift truck or a pallet hand truck. The base 2 includes a bottom ground engaging bar arrangement 3 and spacers 4 supporting a upper load support means in the form of members or a floor panel. At two opposite sides the base 2 has two rails 5 which up stand from the load support.

There are four container side panels 6,7,8,9. The side panels 7 and 9 are taller than the side panels 6 and 8. Retainers 12 on the base are engaged by the bottom edges of the panels 7 and 9 when erected, with the bottom edges of the panels 7 and 9 resting on the base load support. Retainers 12 on the rails 5 are engaged by the bottom edges of the panels 6 and 8 when erected, with the bottom edges of the panels 6 and 8 resting on the rails 5.

The side panels 7 and 9 are side edge coupled each to the two rails 5 in a manner allowing the side panels to pivot into a collapsed condition over the base 2. The side panels 6 and 8 are side edge coupled each to a pair of posts 10 upstanding from the respective ends of the rails 5 in a manner allowing the side panels 6 and 8 to pivot into a collapsed condition over the side panels 7 and 9 when collapsed over the base 2. A lid 11, not essential, is shown mounted to the upper edges of the panels 6 to 9.

The side panels 6 to 9 and the lid 11 are of the same general form including a rectangular shaped frame to which a cover sheet is fixed in a suitable manner. The panels 7 and 9 have angle iron frame members with first flanges of the members coplanar and the cover sheet fixed to the coplanar flanges. The side panels 6 and 8 have angle iron top and bottom edge members joined by frame members of tubular steel, cover sheets are fixed to coplanar surfaces of the tubular members and to coplanar first flanges the angle iron top and bottom edge members. The lid 11 is a rectangular shaped frame of tubular steel members with a cover sheet fixed to the lid frame. The constructions are simple and strong and the cover sheets present an uninterrupted smooth inner support surface for the container. Such a surface is desirable as in many instances the container will be used to carry material or liquid housed in a clear plastic film liner bag which needs to be maintained rupture free.

The retainers 12 for retaining the panels on the base in an upright manner have in-turned hooking flanges under which the out-turned flanges of the angle iron bottom rails 13 of the side panels 7 and 9 hook. Like retainers 12 are provided on the tops of the base rails 6. The rail retainers 12 are engaged by the out-turned flanges of the angle iron bottom rails 15 of the side panels 6 and 8. A shot bolt 16 is provided to prevent lateral disengaging movement of the rails 13 from the retainers 12. No such securement is required for the side panels 6 and 8 as these panels are held separated by the side panels 7 and 9 when erected thereby preventing retainer disengaging lateral movement of the panels 6 and 8.

Figure 2:
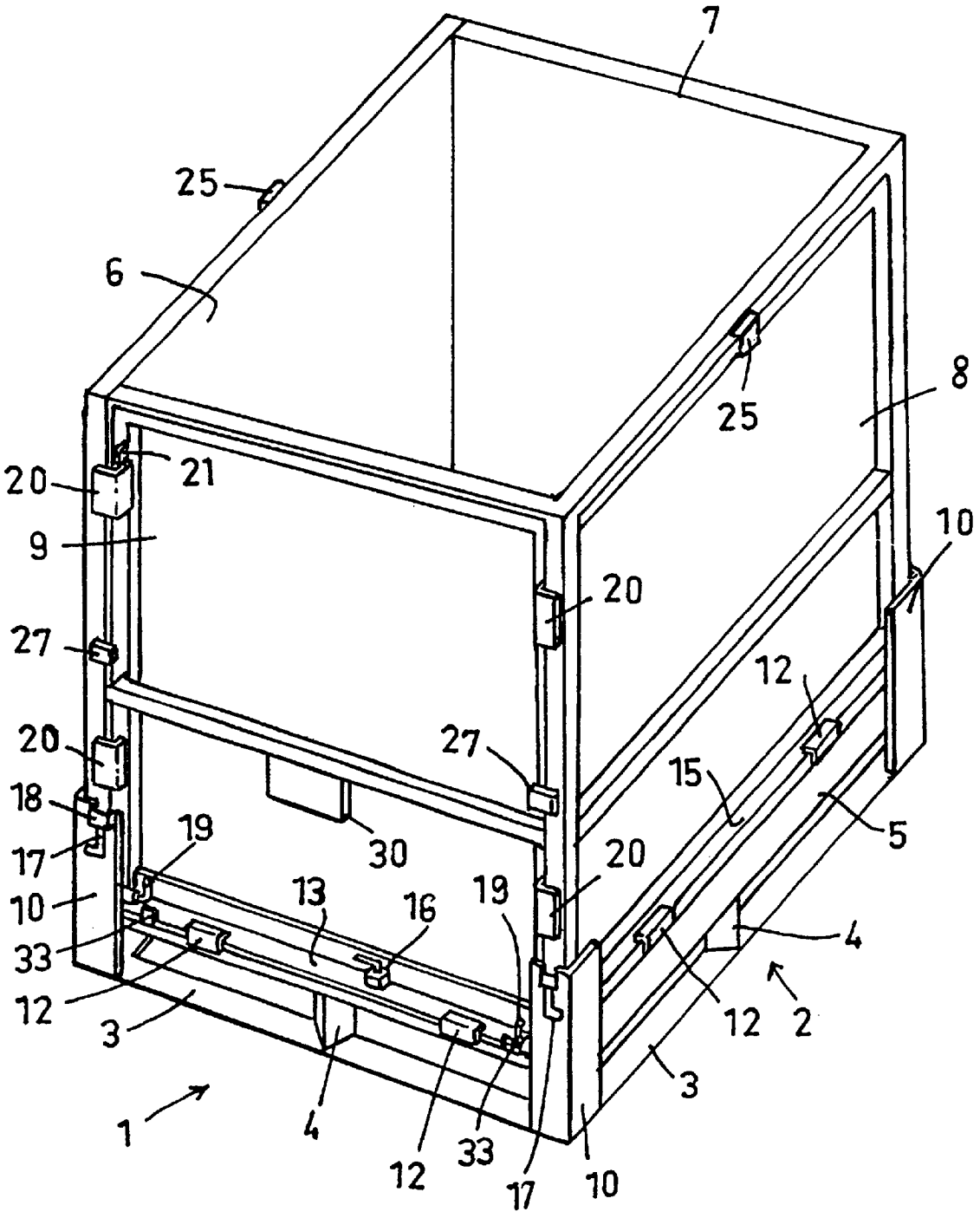
FIG. 2 is a view similar to FIG. 1 with the lid of the container of FIG. 1 removed.

The coupling whereby the side panels 6, 8 can pivot and move laterally and vertically include track follower pins 19 engaged in track slots. Reference should be made to FIGS. 1, 2, 3 and particularly 4 and 5. The pins 14 of the side panels 6 and 8 are engaged in "L" shaped track slots 17 in the posts 10. The slot legs 17*a* are open (for pin passing purposes) at their upper ends with the zones of the leg adjacent the open upper ends of the slots joined by a joggled bridge piece 18. This arrangement allows the pins 14 to escape from the slot legs 17*a* as a side panel 6 or 8 is raised vertically. In this way the panels 6 and 8 can be readily removed for cleaning or repair or replacement. The slot legs 17*a* allow the pins 14 of the side panels 6 and 8 to slide upwardly as the panels 6 and 8 assume a folded down collapsed condition overlying previously collapsed side panels 7 and 9, and if the panel 6 or 8 is the last to be folded then also in an overlying condition over the other (first folded down) of the panels 6, 8. The horizontal portions 17*b* of the slots 17 allow lateral engagement and disengagement movement of the out turned frame flanges 15 of the panels 6 and 8 with the and the base retainers 12.

Figure 5:
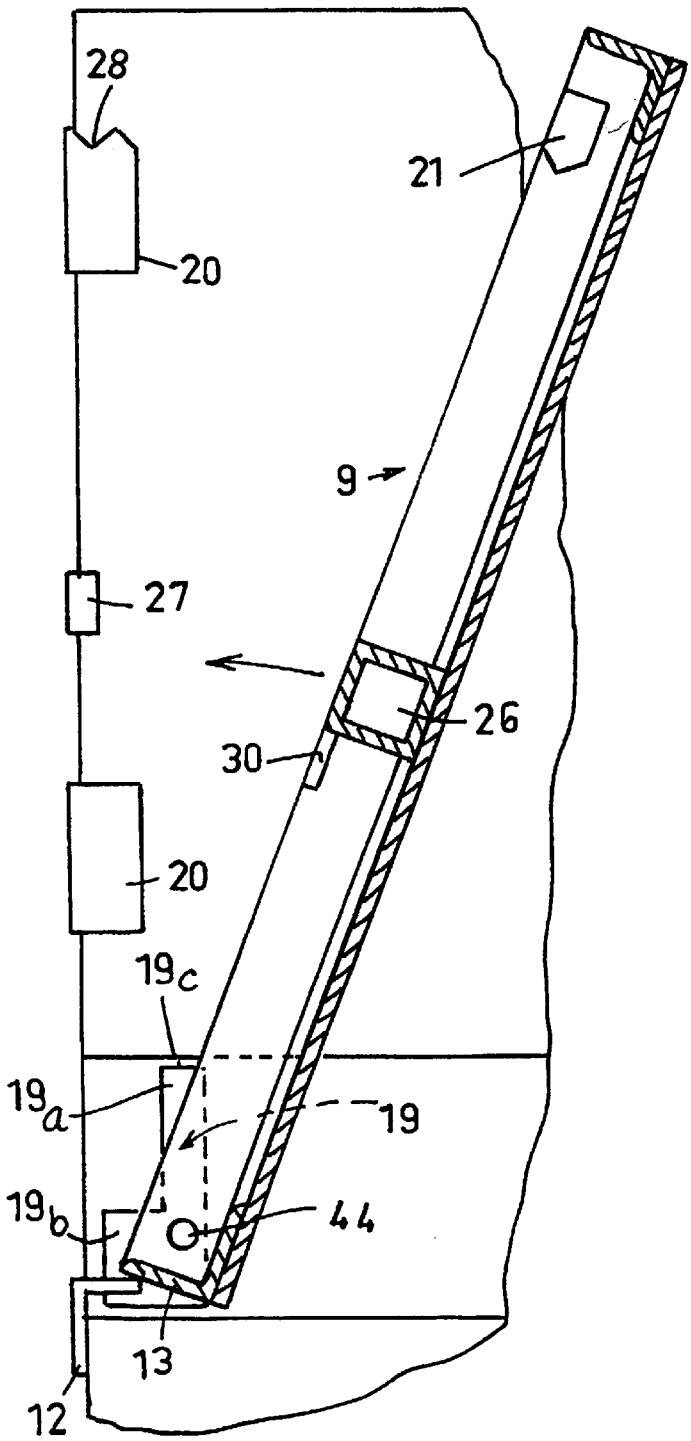
FIG. 5 is a fragmentary sectional edge view showing an early stage in the process of raising a panel from the folded down condition to the upright condition on the container base.

The side panels 7 and 9 are likewise connected to the base through pins 44 and slots 19. The pins 44 would normally be fixed pins but one or both of the pins 44 may be retractable to convert the panels 7 and/or 9 into a slip panel. The slots 19 for the pins 44 are in the inner sides of the rails 5 and are of "L" shape to allow pivoting, lateral and vertical movement of the side panels 6 and 8. As will be seen from FIGS. 4 and 5 the long "L" slot leg 19*a* is narrow and the short "L" leg 19*b* is vertically wide by comparison. The retractable pins 44 are shown spring loaded towards the unretracted condition. By retracting the pin(s) 44 from the co-operating slots part(s) 19*a* allows the panel(s) 7 (9) as a slip panel to be demounted from the base when the side panels 6 and 8 are in the attached and upstanding condition. This is a desirable feature for those operations requiring user access to the interior of the container as a preliminary step to its use. One example is the mounting of a plastic liner bag for liquid in the container prior to filling the liner bag. After placement of the liner bag with its discharge nozzle projecting from an opening in the side panel 7 (not shown) the side panel 9 would then be replaced and secured. Novel means is provided to ensure spring loaded pins 44 are retained in retracted condition for the above operation and will be released and engage in their co-operating slots 19 during a subsequent side panel remounting procedure. This arrangement will be described later. The slots 19 for the pins 44 of the side panels 7 and 9 also includes provision for direct removal of the pins 44 from the slot parts 19*a* when the side panels 6 and 8 are removed. This is essential if the pins 44 of the panels 7 and 9 are not of the retractable type. The arrangement also allows a panel 7 or 9 with retractable pins to be demounted from the base without retracting of the pins.

The means for securing together the container side panels when erected on the base includes hooking members 20 on the upright end edges of the panels 6 and 8 for engagement by the out turned flanges of the angle iron upright end members of the frames of the panels 7 and 9. Whilst this arrangement limits the outward separation of the upper edges of the side panels 6 and 8 and the side panels 7 and 9 some means has to be provided to prevent the converging movement of the upper edges of the side panels 7 and 9. This is achieved by means of lugs 21 on the upright frame members of the side panels 7 and 9 which engage in notches 22 (in a manner to be described later) in the upper edges of the hooking members 20.

The lid 11 is coupled to the side panels by hooks 23 which engage under the top rail of the frame of the panel 7 and hooks 24 which engage in saddles 25 on the top rails of the frames of the side panels 6 and 8. A lid latch 26 of special type (to be described later) is provided.

Part of the innovation provided by the present invention resides in the simplicity of erection of the side panels which minimises the effort required by an operator to erect the larger panels 7 and 9 substantially. The lighter (smaller) side panels 6 and 8 are erected by pivoting them from the collapsed condition with the pins 14 of the panels in the vertical legs 17*a* of the "L" slots 17 acting as pivot connections. As the panels approach the upright condition the pins 14 follow the slot legs 17*a* downwardly to align with the short horizontal legs 17*b* of the slots 17. By applying an outwardly directed force the bottom rails 15 are engaged under the retainers 12 as the pins 14 traverse the slot legs 17*b*.

Figure 6:
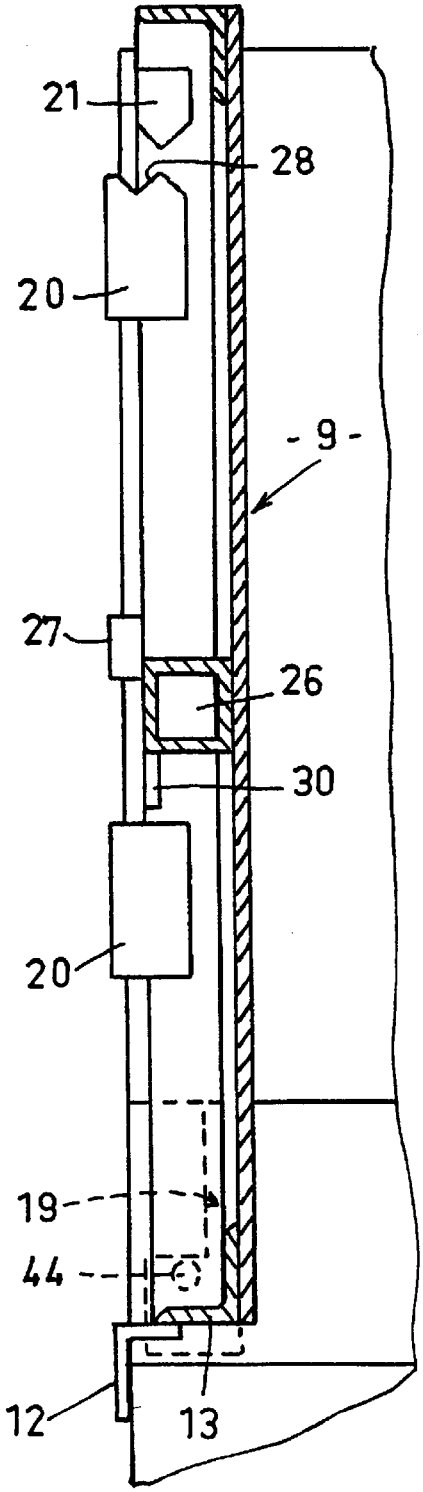
FIG. 6 is a view similar to FIG. 5 showing a later stage in the panel raising process.
Figure 7:
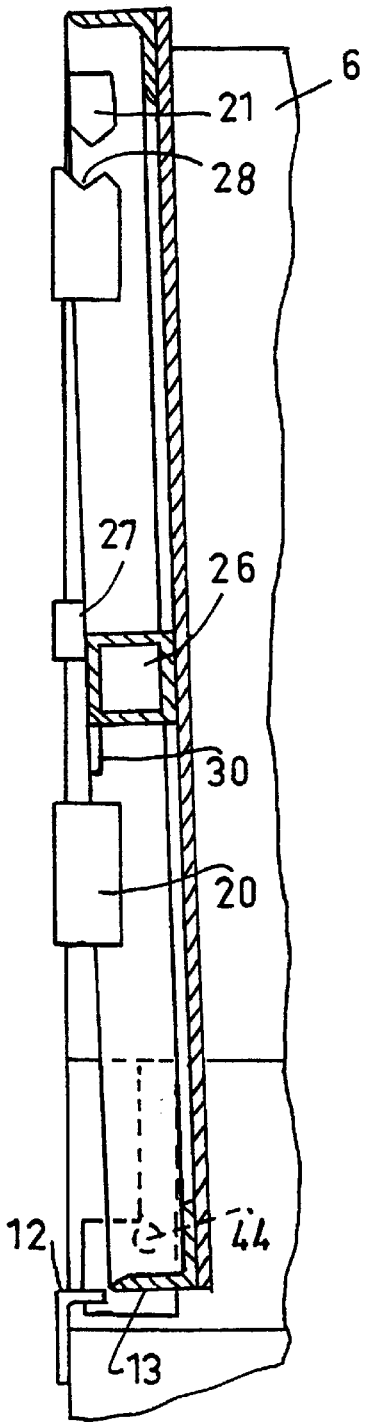
FIG. 7 shows a stage in the panel raising process later than that of FIG. 6.
Figure 8:
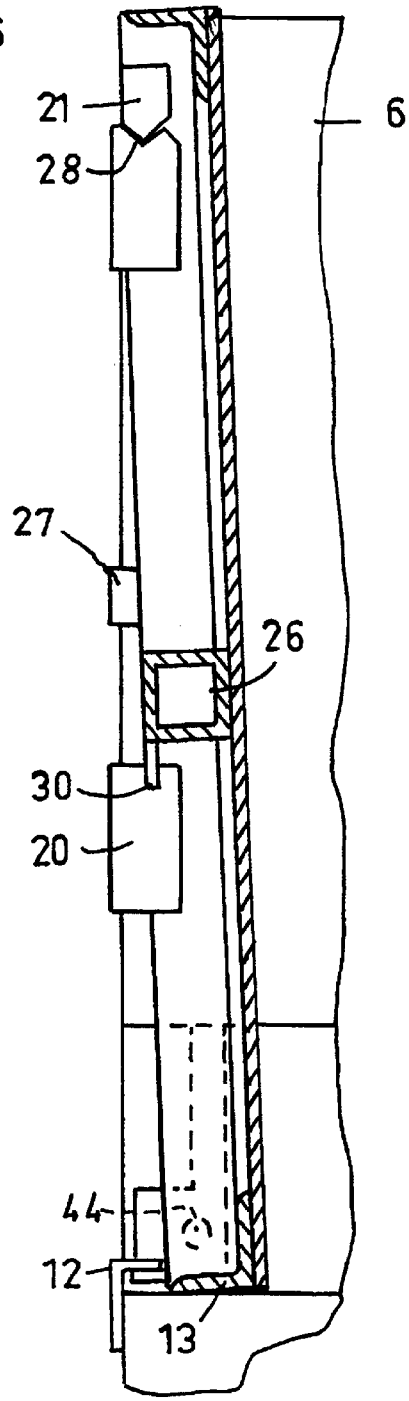
FIG. 8 shows a stage in the panel raising process later than that of FIG. 7.
Figure 9:
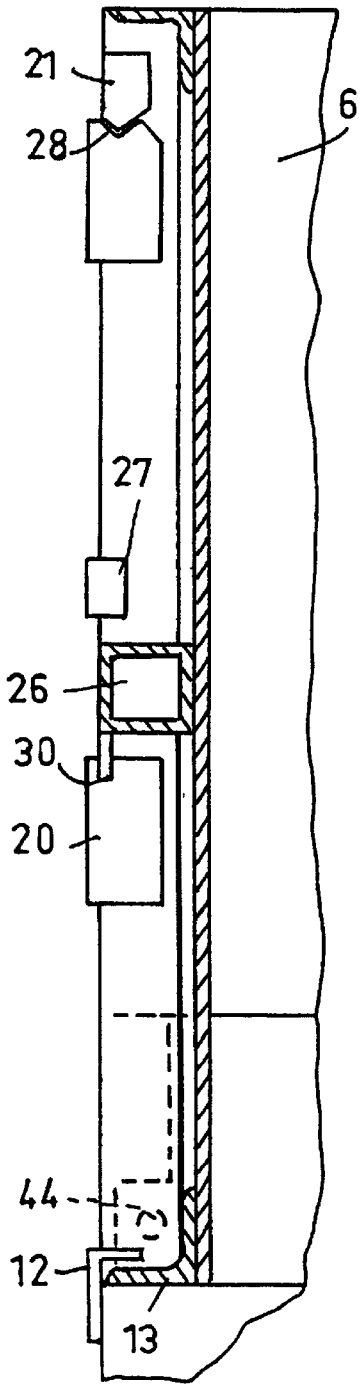
FIG. 9 shows the panel in the erected upstanding condition on the base.

Referring now to FIG. 6 to 10 which illustrate the manner of erecting the heavier and less manageable side panels 7 and 9. In FIG. 6 the side panel 9 is shown in a partly erected condition, to which condition it has been pulled by pulling force applied in the direction of the arrow to the handle 30 on the reinforcement rail 26 of the panel 9. The object is to locate the bottom rail 13 of the panel 9 on top of the base retainers 12 as the panel 9 is moved arcuately to achieve the substantially vertical condition of FIG. 7 with the members 21 and 20 approaching alignment for vertical engagement of the profiled Vee ends of the members 21 in the Vee notches 28. To facilitate this the short leg of the slot legs 17*b* are sufficiently wide to accommodate the pivot pin 14. It will be noted that at this stage there will be abutting engagement of the central reinforcement bar 26 of the panel 9 with lugs 27 on the upright end members of the panels 6 and 8, this occurs as the Vee shaped ends of the lugs 21 on the panel 9 are located over, but not directly aligned with, the notches 28 in the top hook members 20. By then applying further effort, as shown by the arrow at the top of the panel 9 (FIG. 7), the Vee shaped ends of the lugs 21 will be moved towards engaging alignment with the correspondingly shaped notches 28, the panel 9 will pivot with the contact between the bar 26 and the lugs 27 acting as a fulcrum, and as a result the bottom rail 13 of the panel 9 will swing away from the retainers 12, see FIG. 8. Immediately the rail 13 is no longer supported by the retainers 12 the panel 9 will drop to the FIG. 9 condition in which the Vee shaped lower ends of the lugs 21 have nested into the correspondingly shaped notches 28. This lowering action places the panel bottom rail 13 below the retainers 12 and further pivoting of the panel 9 by effort applied to the handle 30 (with the engagement of the lug 21 in the notch 28 acting as a fulcrum)will engage the out turned flange of the bottom rail 13 under the retainers 12, see FIG. 10. The panel is held in this position by means of a shot bolt 16. The above sequence is a smooth continuous low effort operation which allows a user to readily erect the heavy panels 7 and 9 following the erection of the panels 6 and 8.

Figure 12:
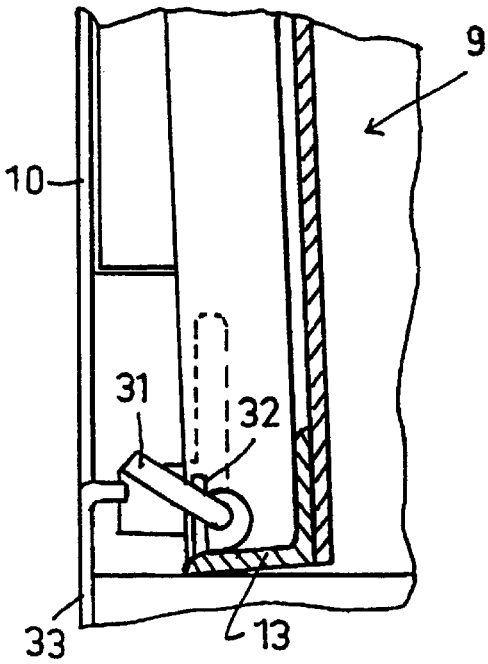
FIG. 12 is a view similar to FIG. 11 with the retractable pin latched in the retracted condition.

FIGS. 11 and 12 show the reverse sequence. After release of the shot bolt 16 the rail 13 is "kicked" free of the retainers 12 by the operator to move the panel 9 from the FIG. 11 condition to the FIG. 12 condition. The lug 21 is disengaged from the notch 28 whilst the panel 9 is held with a foot in the retainer disengaged condition. The panel 9 is then tilted at the top by a few degrees to position the bottom of the rail 13 against the leading edge of the retainers 12, see FIG. 6. As the rail 13 can now no longer enter below the retainers 12 the side panel 9 can be pivoted to a lowered condition against abutting engagement of the rail 13 with the retainers 12. It is to be noted that the amount of movement of the panel 9 required to disengage the lug 21 from the notch 28 exceeds the clearance between the rail 13 and the retainers 12 so that so long as the rail 13 is engaged with the retainers 12 an engaged lug 21 cannot be disengaged from the notch 28.

As referred to briefly previously, the pins 44 as illustrated are shot bolts spring loaded to the extended position where they are engaged with the slots 19. As will be clear from FIG. 5 the notches 19*c* in the rail top face will allow the panel 9 to be disengaged by vertical movement (when the side panels 6 and 8 are removed) to slide the pins 44 through the notches 19*c*. However, when the panels 6 and 8 are in place and the panel 9 needs to be removed it can perform as a slip panel when the shot bolt pins 44 have to be withdrawn from the slots 19. For safety reasons the design to be described only allows the shot bolt pins 44 to be held removed from the slots 19 when the rail 13 is disengaged from the retainers 12.

Figure 13:
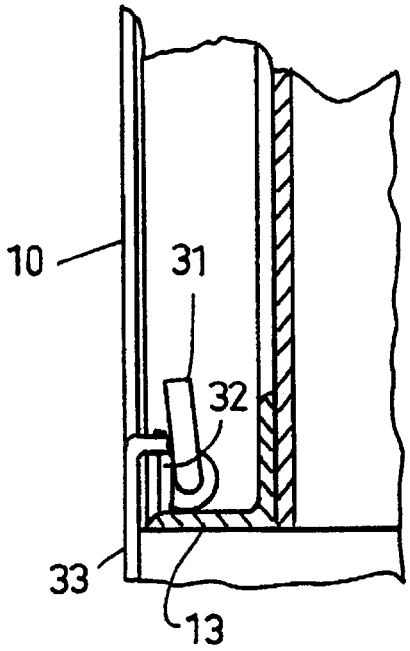
FIG. 13 is a view as the panel is moved from the FIG. 12 condition to the FIG. 11 condition.
Figure 14:
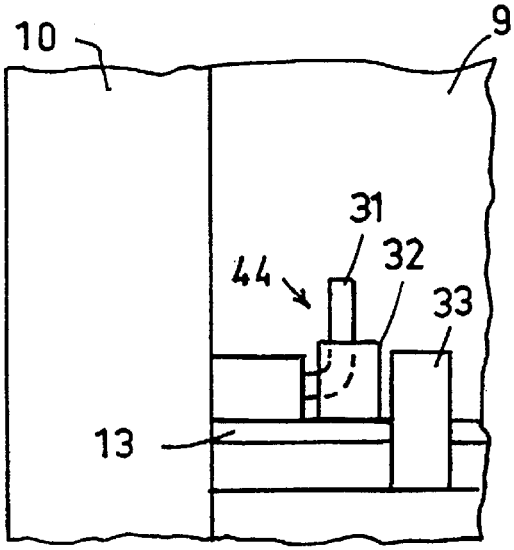
FIG. 14 is a fragmentary front view showing the retractable pin in the position shown in FIG. 11.
Figure 15:
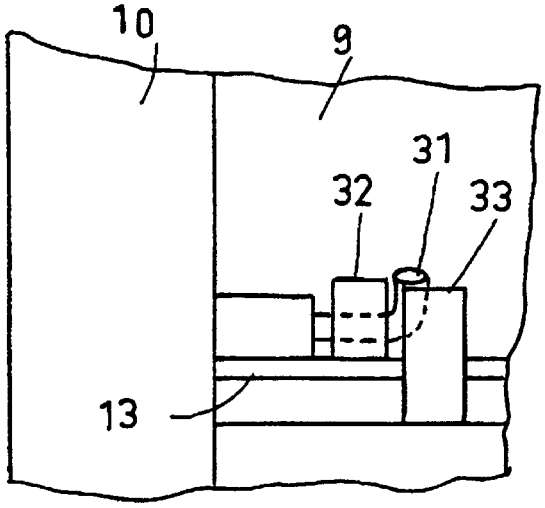
FIG. 15 is a view similar to FIG. 14 showing the retractable pin in the position shown in FIG. 12.
Figure 16:
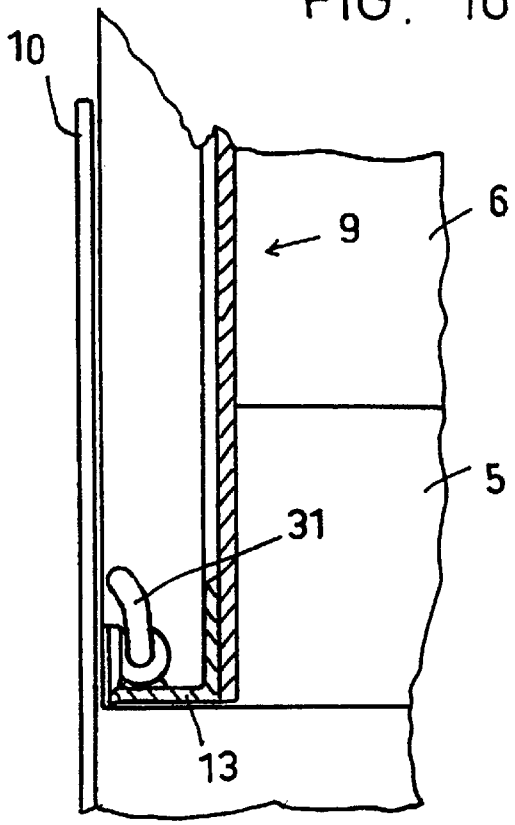
FIG. 16 is a fragmentary sectional edge view showing the positioning of a second form of retractable pin for coupling the panel to the base, with the panel in the erected condition.
Figure 17:
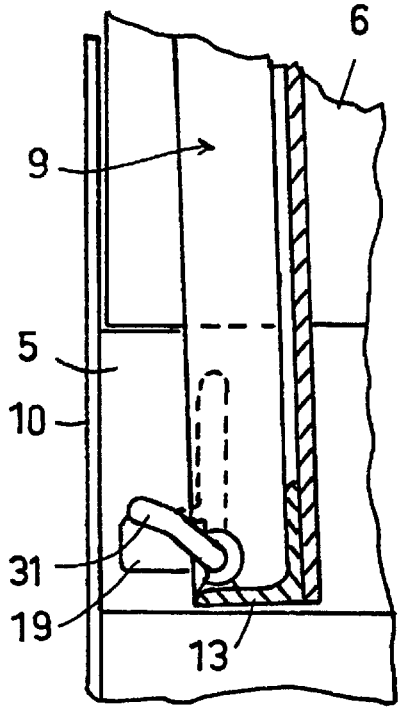
FIG. 17 is a view similar to FIG. 16 with the retractable pin latched in the retracted condition.
Figure 18:
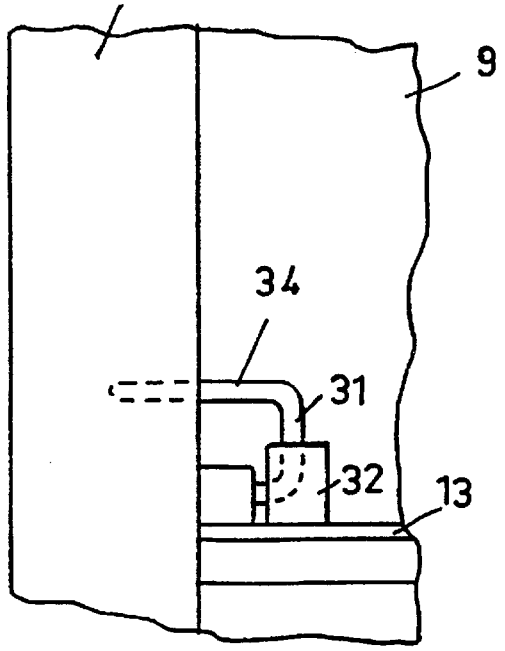
FIG. 18 is a fragmentary front view showing the retractable pin in the position shown in FIG. 16.
Figure 19:
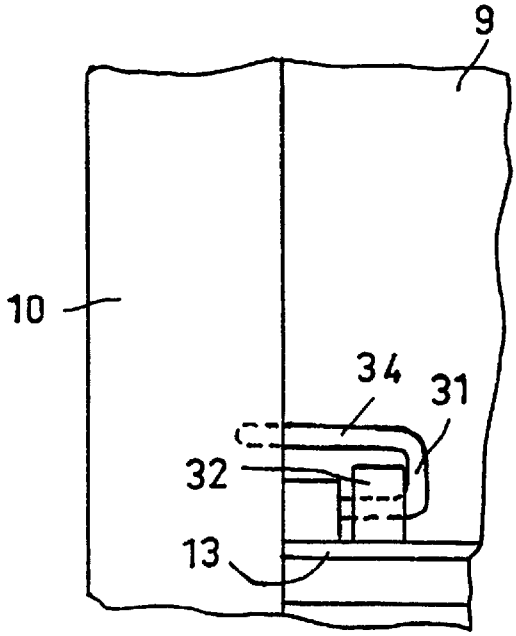
FIG. 19 is a view similar to FIG. 18 showing the retractable pin in the position shown in FIG. 17
Figure 20:
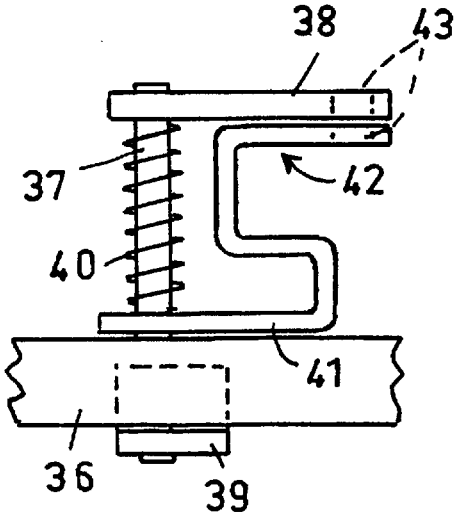
FIG. 20 is a scrap view of the lid lock in the latched condition.
Figure 21:
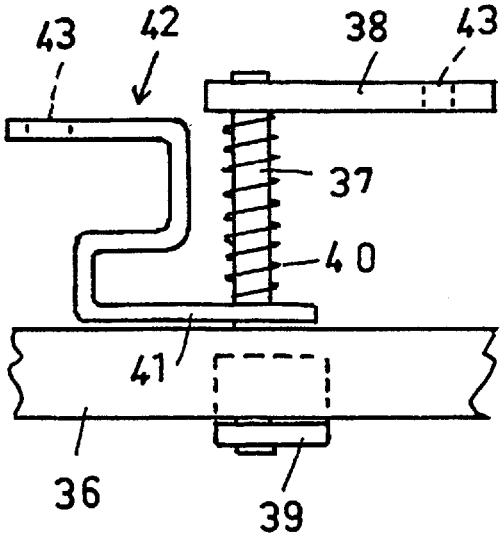
FIG. 21 is a view similar to FIG. 20 showing the lid lock component arrangement when the lid lock is about to be released.

FIGS. 1 and 13 illustrate an out turned end 31 on the pin 44 and a lug 32 on the rail 13 to capture the pin end 31 when retracted , see FIG. 14. It will be noted that the pin end 31 when captured by (hooked behind) lug 32 is aligned with a further lug 33 on the base 2 adjacent the retainers 12. The working relationship of the foregoing members will be clear from FIGS. 15 to 17. With the side panel 9 in the upright position of FIG. 15 the shot bolt pin 44 can be withdrawn but the lug 33 prevents capture of the end 31 with the lug 32. However, when the rail 13 is disengaged from the cleats 12 capture is possible, see FIG. 16. It follows that if the rail-retainer engagement 13–12 is freed then the pin end 31 can be captured by the lug 32 and that in a panel remounting operation movement of the panel 9 in the direction of the arrow in FIG. 17 will cause the pin end 31 to be engaged by the lug 33 to release it from the lug 32. The spring loading on the shot bolt pin 44 will cause the pin to fly into the aligned slot 19 in the rail 5.

In an alternative arrangement, see FIGS. 18 to 21, the shot bolt end 31 is provided with a return leg 34. The end 31 will engage lug 32 as previously but instead of the end 31 being engaged by a separate lug 33 the return leg 34 will be engaged by the inner face of the rail leg 10 to accomplish the same result as engagement of the pin end 31 with the lug 33.

The latch 26 of the lid 11 referred to in passing will now be described in detail with reference to FIGS. 22 to 25. The numeral 36 indicates the front frame member of the lid 11 and in a hole there through there is mounted a shaft 37 with a handle 38 at one end and a hook 39 at the other. There is a spring 40 about the shaft 37 urging the hook 39 against an outer face of the frame member 36. The pin 37 also passes through a hole in a limb 41 of a gooseneck security member 42. The spring 40 urges the limb 41 against the inner face of the frame member 36. It is to be noted that the shaft 37 is not at the mid-width position of the hook 39 but is offset to one side of centre.

Figure 22:
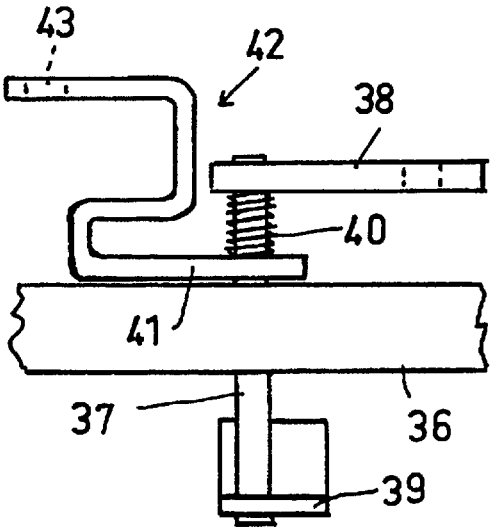
FIG. 22 is a view similar to FIG. 21 with the lid lock released and FIG. 23 is a view showing the lid lock in its unlatched storage condition.

In FIGS. 1 and 22 the latch is shown in the operative position with the hook leg in turned under the frame member 36, and as will be understood, under the out turned flange of the angle iron top rail of the side panel 9 in an assembly as shown in FIG. 1. The hook 39 thus prevents the lid being slid rearwardly to disengage the hooks 23 and 24. A seal or padlock can be passed through holes 43 in the members 38 and 41 to prevent release of the hook 39.

Figure 23:
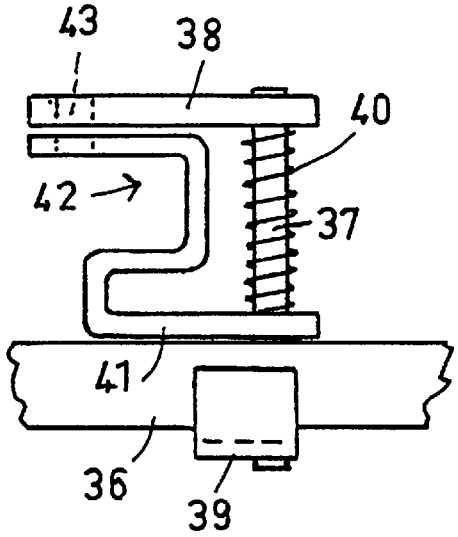

In a hook release sequence the security member 42 would be rotated about the shaft 37 to the FIG. 23 position. This is followed by a compression of the spring 40, see FIG. 24, followed by a 180 degree rotation of the shaft 37 to place the hook in the rotational position of FIG. 25 with the hook 39 now above the frame member 39. The lid 11 can now be slid rearwardly to release the lid hooks 23 and 24 from the top rails of the side panels 6, 7, 8 after which the lid 11 can be removed.

To facilitate the operation of the latch, by minimising the number of operations needed to reactivate the latch, the hook is set offset to the shaft 37. The reason is that in a relatching operation from the FIG. 25 condition without flipping over the security member 42 the shaft can be rotated sufficiently to allow the handle member 28 to pass over the security member 42 in a spring compressing sequence. The hook can then be rotated 180 degrees and engaged under the frame member 39 (see FIG. 23) and the security members would then be flipped over to the FIG. 22 condition. If the shaft was not offset relative to the hook the sequence would involve a double movement of the security member 42, it would be first moved from the FIG. 25 condition to the FIG. 22 condition, the spring 40 would be compressed whilst the member 38 was in the FIG. 25 condition and before it could be rotated 180 degrees the security member 42 would have to be flipped back to the FIG. 24 condition, if this was not done the hook would be prevented from rotating by contact between the member 38 and the security member 42. After the flip over of 42 was completed the hook 39 could be rotated and the FIG. 23 condition could be adopted. The security member 42 would then have to be flipped back to achieve the FIG. 22 configuration. It will be seen that by the simple expedient of offsetting the shaft 37 relative to the hook 39 the operation of the lid latch is greatly simplified.

It will be seen from the forgoing descriptions that the container as proposed by the present invention is simple, includes safeguards against unauthorised disconnection of inter-engaging elements, is simple to erect, allows side panels to be readily removed and is robust in nature. It is to be understood however that changes may be made to specific details given herein in the preferred arrangements without departing from the inventive concepts herein disclosed. By way of example, many of the features herein disclosed would be usable where pin in slot connections between the side panels and the base were replaced by other means allowing the side panels to be folded down one over the other and all over the base.

What is claimed is:

1. A container comprising a four sided base, four side panels, coupling means coupling said panels respectively to the base at the four sides of the base, said coupling means allowing the panels to be moved between operative condition where they are upstanding on the base and storage condition where the panels lie one over the other over the base, releasable securing means to secure together adjacent edges of the panels when they are upstanding on the base, the panels are arranged in pairs with a first pair of panels of a first height respectively mounted at two opposite sides of the base and coupled by the coupling means to corner posts on the base, the panels of said first pair when upstanding rest on raised rails on the base at opposite sides of said base extending between corner posts of the base and are engaged with retainers on said rails, the other pair of panels are of greater height that said first pair of panels and are respectively coupled by said coupling means to corresponding ends of said rails and when upstanding rest on the base and are engaged with retainers on the base, said coupling means comprises track followers on the panels and tracks in said posts and said rails, said track followers can pivot in said tracks to allow arcuate movement of said panels, each of said tracks has a first portion which is open at one end and communicates at a second end with a track further portion, track followers when engaged in said track first portions can move in directions towards and away from the base to allow the panels after arcuate movement to be stacked one on the other on the base, said track followers when engaged in said further track portions can move in directions substantially parallel to the plane of the base to allow engagement and disengagement of the panels when upstanding with said retainers, all of the panels can be demounted from the base by disengagement of their track followers from the first portions of said tracks through the open ends thereof, the panels of said first panel pair occlude the open ends of the first portions of the rail tracks thereby preventing the removal of the panels of said other panel pair prior to the demounting from the base of the panels of said first panel pair.

2. A container as claimed in claim 1 wherein said tracks are L shaped.

3. A container as claimed in claim 1 wherein said rails each have at least an upstanding inner wall and a top face on which a panel of said first panel pair rests when the panel is upstanding, the rail track first and further portions are in the inner walls of said rails and there is a notch in said rail top face to provide the open end for the first portion of each rail track, the track engaging track followers of the panels of said other panel pair extend through and beyond the inner walls of said rails and lie below the rail top faces and the removal of the track followers of the panels of said other panel pair is from the rail tracks is prevented by the panels of said first panel pair.

4. A container as claimed in claim 1 wherein the corner posts of the base are upstanding angle members each with two leg parts, the leg parts of each angle member respectively overlie portions of two adjacent base sides at the comers of the base, one of the leg parts of each corner post is a track leg and has the first and further portions of a post track therein with the open end of the track first portion located at an upper end of said post, the track engaging track followers of the panels of said first panel pair extend through said track legs and the track legs each have a bridge joining track leg zones to either side of the open ends of the track first portions, said bridges are spaced outwardly from said track legs so as to allow removal of the track followers of the panels of the first panel pair from the tracks.

5. A container comprising a four sided base, four side panels, coupling means coupling said panels respectively to the base at the four sides of the base, said coupling means allowing the panels to be moved between operative condition where they are upstanding on the base and storage condition where the panels lie one over the other over the base, releasable securing means to secure together adjacent edges of the panels when they are upstanding on the base, the panels are arranged in pairs with a first pair of panels of a first height respectively mounted at two opposite sides of the base and coupled by the coupling means to corner posts on the base, the panels of said first pair when upstanding rest on raised rails on the base at opposite sides of said base extending between corner posts of the base and are engaged with retainers on said rails, the other pair of panels are of greater height that said first pair of panels and are respectively coupled by said coupling means to corresponding ends of said rails and when upstanding rest on the base and are engaged with retainers on the base, said coupling means comprises track followers on the panels and tracks in said posts and said rails, said track followers can pivot in said tracks to allow arcuate movement of said panels, each of said tracks has a first portion which is open at one end and communicates at a second end with a track further portion, track followers when engaged in said track first portions can move in directions towards and away from the base to allow the panels after arcuate movement to be stacked one on the other on the base, said track followers when engaged in said further track portions can move in directions substantially parallel to the plane of the base to allow engagement and disengagement of the panels when upstanding with said retainers, said retainers comprise hookingly engaged complementarily shaped hooking elements on said panels and on said rails and said base, said securing means including notched members on the panels of said first panel pair and lugs on the panels of said other panel pair shaped to engage in notches of said notched members and when so engaged provide a pivot point for pivotal movement of panels to hookingly engage and disengage said retainers.

6. A container as claimed in claim 5 having first abutment on the panels of said first panel pair and second abutments on the panels of said other panel pair, and wherein the complementarily shaped hooking elements can assume an overlying relationship or a hooking relationship, the positioning of said abutments and the notched members and said lugs being such that as the panels of said other panel pair are arcuately moved from the storage condition to the operative condition the hooking elements will assume an overlying condition with further arcuate movement causing engagement of the abutments as said lugs move towards an engagement alignment with notched members, the engaged abutments act as a pivot point so that still further arcuate movement of said panel to align said lugs and notched members for engagement will cause disengagement of said hooking elements followed by downward movement of the panel towards the base to engage the lugs with the notched members and to disengage said abutments, the engaged lugs and notched members act as a pivot point for the arcuate movement of the panel to hookingly engage the hooking elements of said retainers.

7. A container as claimed in claim 5 wherein the notch of each notched member is of Vee shape and each lug has a Vee shaped face to engage said Vee shaped notch, the profile of said Vees being such that disengagement of the lugs from the notched members can be readily manually achieved by applying a dislodging force to the panel in the region of said lugs.

8. A container comprising a four sided base, four side panels, coupling means coupling said panels respectively to the base at the four sides of the base, said coupling means allowing the panels to be moved between operative condition where they are upstanding on the base and storage condition where the panels lie one over the other over the base, releasable securing means to secure together adjacent edges of the panels when they are upstanding on the base, the panels are arranged in pairs with a first pair of panels of a first height respectively mounted at two opposite sides of the base and coupled by the coupling means to corner posts on the base, the panels of said first pair when upstanding rest on raised rails on the base at opposite sides of said base extending between corner posts of the base and are engaged with retainers on said rails, the other pair of panels are of greater height that said first pair of panels and are respectively coupled by said coupling means to corresponding ends of said rails and when upstanding rest on the base and are engaged with retainers on the base, said coupling means comprises track followers on the panels and tracks in said posts and said rails, said track followers can pivot in said tracks to allow arcuate movement of said panels, each of said tracks has a first portion which is open at one end and communicates at a second end with a track further portion, track followers when engaged in said track first portions can move in directions towards and away from the base to allow the panels after arcuate movement to be stacked one on the other on the base, said track followers when engaged in said further track portions can move in directions substantially parallel to the plane of the base to allow engagement and disengagement of the panels when upstanding with said retainers, all of the panels can be demounted from the base by disengagement of their track followers from the first portions of said tracks through the open ends thereof, the panels of said first panel pair occlude the open ends of the first portions of the rail tracks thereby preventing the removal of the track followers of said other panel pair from their associated tracks prior to the demounting from the base of the panels of said first panel pair, and wherein at least one of the panels of said other panel pair is a slip panel having at least one of its track followers retractable to allow subsequent manipulation of the slip panel to disengage it from said base whilst the panels of said first panel pair remain coupled to the base.

9. A container as claimed in claim 8 wherein said retractable track follower is resiliently biassed to its non-retracted condition.

10. A container as claimed in claim 9 wherein a latch lug is provided on the slip panel for engagement by a leg of said track follower to hold said track follower retracted when said slip panel is disengaged from said retainers.

11. A container as claimed in claim 10 wherein a latch releasing means is provided on said base to dislodge said track follower leg from said latch lug when the slip panel is engaged with said retainers.

12. A container as claimed in claim 11 wherein the latch releasing means is a lug on said base.

13. A container as claimed in claim 11 wherein the latch releasing means is a base corner post.

14. A container as claimed in claim 8 in combination with lid lugs and sockets to couple the lid to erected container panels as the lid is slid relative to the container, and releasable lid latching means to latch said lid against uncoupling sliding movement of the lid relative to the container.

15. A container and lid combination as claimed in claim 14 therein the lid latching means comprises a shaft slidably and rotatably mounted on the lid with an axis of sliding in a plane substantially parallel to the plane of said lid, a hook on an outer end of said shaft, a handle on the other end of said shaft, spring means to bias said shaft towards hooking engagement of said hook with a panel frame member, a releasable securer to hold the shaft of the lid latching means against unlatching sliding movement.

16. A container and lid combination as claimed in claim 15 wherein said securer comprises a member pivotally mounted on said shaft so as to be movable between a securing position where it is disposed between said handle and a frame member of said lid to prevent sliding movement of said shaft to unhook said hook from a panel frame member, and a release position where sliding movement of said shaft is possible.

* * * * *